United States Patent [19]

Panton, Jr.

[11] Patent Number: 4,935,964

[45] **Date of Patent: * Jun. 26, 1990**

[54] STRETCHABLE NECKTIE

[76] Inventor: George S. Panton, Jr., 400 Coral Avenue, Melbourne Beach, Fla. 32951

[ * ] Notice: The portion of the term of this patent subsequent to Jun. 20, 2006 has been disclaimed.

[21] Appl. No.: 367,797

[22] Filed: Jun. 19, 1989

Related U.S. Application Data

[63] Continuation of Ser. No. 267,654, Nov. 4, 1988, which is a continuation of Ser. No. 74,965, Jul. 17, 1987, abandoned.

[51] Int. Cl.[5] ..... A41D 25/06

[52] U.S. Cl. ..... 2/146

[58] Field of Search ..... 2/144, 146, 147, 155; 66/178 A, 202

[56] References Cited

U.S. PATENT DOCUMENTS

| | | | |
|---|---|---|---|
| 854,284 | 5/1907 | Frost | 2/155 |
| 1,495,535 | 5/1924 | Scott | 2/155 |
| 1,511,793 | 10/1924 | Worms | 2/144 |
| 1,654,769 | 1/1928 | Waters | 2/146 |
| 1,705,473 | 3/1929 | Gold | 2/146 |
| 2,611,900 | 9/1952 | Hertz | 2/146 |
| 2,949,023 | 8/1960 | Holmes | 66/202 X |
| 3,290,904 | 12/1966 | Snyder | 66/178 A |
| 3,426,360 | 2/1969 | Ackerman | 2/146 |
| 3,562,814 | 2/1971 | Ackerman | 2/146 |
| 3,824,627 | 7/1974 | Schon | 2/146 |
| 4,229,834 | 10/1980 | Alexander | 2/146 |
| 4,839,925 | 6/1989 | Panton | 2/146 |

*Primary Examiner*—Werner H. Schroeder
*Assistant Examiner*—Diana L. Biefeld
*Attorney, Agent, or Firm*—Ronald P. Kananen

[57] ABSTRACT

A stretchable necktie fabricated from an elongated outer tubular casing formed of a nylon-spandex material, and an elongated inner lining formed of a nylon-spandex material, positioned inside said casing and sewn around its entire perimeter to said casing. A washable, comfortable necktie is thereby formed entirely of stretchable material.

4 Claims, 1 Drawing Sheet

STRETCHABLE NECKTIE

This is a continuation of copending application Ser. No. 267,654 filed on Nov. 4, 1988, which is a continuation of Ser. No. 074,965 filed July 17, 1987 now abandoned.

BACKGROUND OF THE INVENTION

The present invention relates to neckties and methods of constructing them. It more particularly relates to neckties having an outer tie casing and an inner tie lining secured therein, and methods of constructing them.

Numerous designs and constructions of neckties are known. One design uses only a tie casing formed from a cut elongated piece of material which is secured along its length to form an elongated fabric tube. One example of such is a tie formed with a double face fabric which is made of a single initial woven component composing two textile layers joined together by means of binding wefts, such as shown in U.S. Pat. No. 3,824,627. This single layer tie construction approach suffers from many disadvantages including poor stretch and knotting characteristics, the lack of satisfactory bulk and body, and also, the inability to use a variety of materials and styles.

Thus, ties typically comprise an outer necktie casing and an inner necktie lining secured therein. The casing can be formed of polyester or silk and the lining is typically formed of cotton. U.S. Pat. Nos. 3,426,360 and 3,562,814 discuss some of the prior art teachings and the necktie constructions described therein show composite linings having two layers which are substantially continuous and secured together. U.S. Pat. No. 4,229,834 discloses a necktie having a fabric casing folded longitudinally and a lining fabricated of double woven material. These neckties though suffer from the disadvantages in that they can be become easily soiled by dirt and perspiration from the wearer's neck and his hands when he adjusts the tie, and from various other stains such as foods and drinks which may spill on the tie when being consumed. Due to the coloring, fabric and visibility of the tie, the ties should not be worn again until cleaned, and this cleaning usually entails the inconvenience and expense of dry cleaning. For particularly troublesome spots even dry cleaning will not work and the soiled ties must be discarded, which then involves the additional trouble and expense of replacing the tie.

Further, it is also common for people wearing neckties of traditional fabrication to experience discomfort during the day and to have to adjust the tie frequently. They often towards the end of the day will loosen the tie so that it is not snug against their collar and this is not very attractive grooming. Accordingly, a need has developed for an improved necktie construction.

It is thus a principal object of the present invention to provide an improved necktie construction.

Another object of the present invention is to provide an improved necktie which can be washed with soap and water to remove perspiration, soil or other stains and then ironed.

A further object of the present invention is to provide an improved necktie which is comfortable to wear and does not require adjustment throughout the day to make it more comfortable.

A still further object of the present invention is to provide an improved necktie construction which when washed with soap and water does not shrink.

Another object of the present invention is to provide an improved necktie construction which does not discolor.

A further object of the present invention is to provide an improved necktie construction which is attractive and does not present a bulky appearance.

A still further object of the present invention is to provide novel neckwear with excellent knotting ability.

Other objects and advantages of the present invention will become more apparent to those skilled in the art from the accompanying description taken in conjunction with the accompanying drawings.

DETAILED DESCRIPTION OF THE PREFERRED EMBODIMENTS OF THE INVENTION

Figure 1:
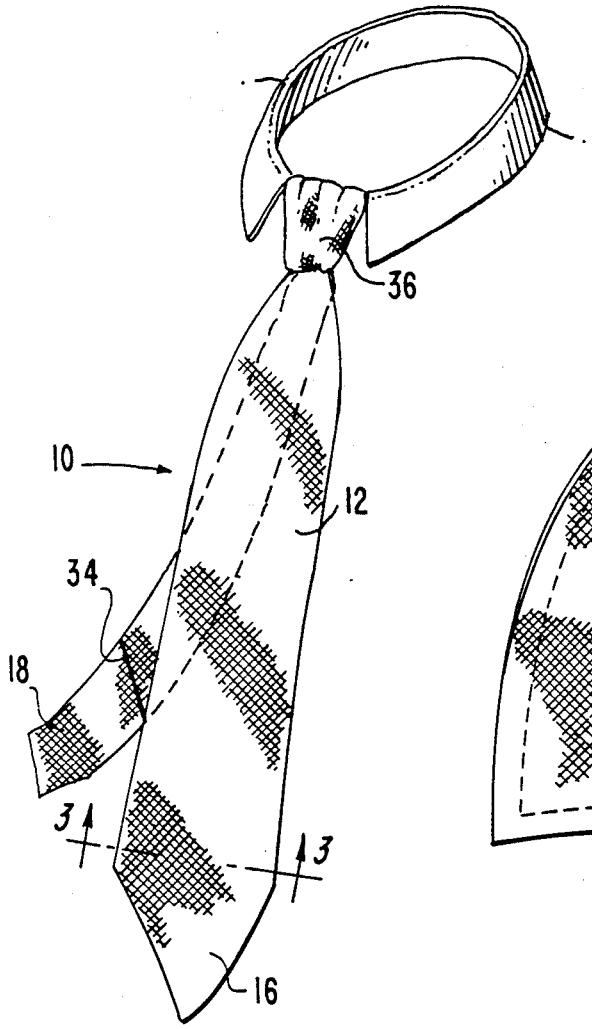
FIG. 1 is a perspective view of a stretchable necktie of the present invention shown in its knotted configuration.

Referring to the drawings, a stretchable necktie according to the present invention is illustrated generally at 10. Necktie 10 very simply comprises an elongated outer casing 12 and an elongated inner lining 14 secured thereto and therein. The outer casing is formed of nylon spandex fiber and an example of such a spandex fiber is that available from DuPont Company and distributed under the trademark "Lycra". "Lycra" performs like natural elastic but is stronger, more durable, and has greater restraining power. "Lycra" has been accepted in the foundation and swimwear markets, and also for surgical stockings, men's sock tops and football pants. In addition to exercisewear, dancewear and swimwear, "Lycra" has been used for intimate apparel, outerwear and sportswear, knit wear and hosiery. "Lycra" is a long chain synthetic polymer, of which at least 85% is comprised of a segmented polyurethane, and it thus performs like a natural elastic. It is made of an adaptable manmade fiber composed entirely of non-cellulosic material. Since small percentages of spandex provide ample stretch and recovery or holding power, garments are never made of 100% spandex, but rather the spandex is used in combination with other fibers including nylon, cotton, polyester, wool and acrylic. The presence of spandex in a fiber gives the fabric fluidity, drapability, comfort and a sensuous feel. Fibers containing spandex may be washed with soap and water and drip dried and tumble dried and then ironed.

A preferred embodiment of the spandex fiber for casing 12 of the present invention is an "Antron" nylon-"Lycra" spandex material such as used in the swimwear industry with a bright yarn finish and a bright luster in a range of 70–90% nylon, cotton, or polyester to 10–30% "Lycra" or e.g. 85% nylon with 15% "Lycra" or any combination in a range of nylon, cotton, or polyester greater than 70% with "Lycra" comprising the remainder. With these contents the stretch obtained is 10% to 30%. To eliminate some of the bulkiness caused by cotton liners, the preferred design of the present necktie 10 uses a lining 14 formed from a nylon-"Lycra" fabric similar to that of the casing. Thus, the necktie 10 is constructed entirely of stretchable material.

Figure 2:
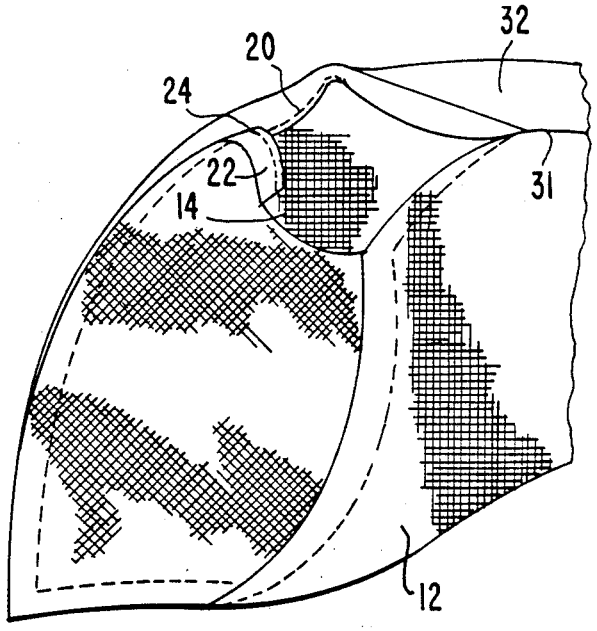
FIG. 2 is a enlarged perspective view of either end of the necktie of FIG. 1 with the casing and liner shown in partial disassembled relation for the sake of clarity.

Necktie 10 is formed by cutting or otherwise forming the casing 12 and the lining 14 of two elongated pieces of the above-described spandex materials. The casing 12 and lining 14 are configured to define a traditional pointed design at both the outer (when knotted and worn) and inner ends as shown in FIG. 1 at 16 and 18, respectively. Along the entire end edges as shown in FIG. 2 a hem 20 is formed in the outer casing 12 folded inward or towards the lining 14 and a similar hem 22 is formed outwards or towards the casing 12 along the entire end edge of the lining 14. These hems 20, 22 are positioned adjacent and facing one another and then sewn together along their entire length by stitching 24 which extends only through the two hems 20, 22 and not through the surfaces of either the lining 14 or casing 12, as best shown in FIG. 2. Thus when assembled the threads of stitching 24 do not extend through either of the surfaces and thus are not visible when necktie 10 is worn.

Figure 3:
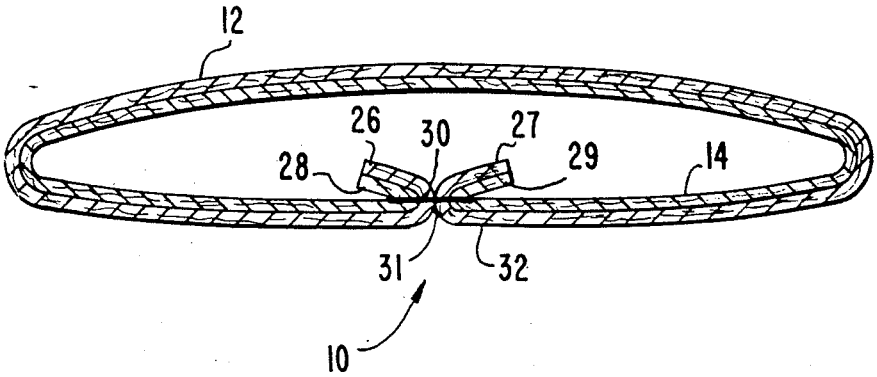
FIG. 3 is a cross sectional view taken along line 3—3 of FIG. 1.

Both of the elongated side edges 26, 27, 28 and 29 of both the casing 12 and the lining 14, respectively, are folded together towards the center of the casing 12 and then sewn together by stitching 30 along the inner surface and along the length of the tie 10 as shown in FIGS. 2 and 3. Thus, an inwardly configured seam 31 as best shown in FIG. 3 is formed along the entire length of the inner surface 32 of the necktie 10.

It is also within the scope of the present invention to form the necktie of two parts which are sewn together as along an inwardly formed seam 34 of FIG. 1. As can be appreciated seam 34 is formed along the inner thinner portion 18 of the necktie when tied and thus is not usually visible when the tie is worn.

Necktie 10 due to this construction and its material forms a very comfortable tie which when knotted as at knot 36 needs no adjustment during the day. The knot remains positioned because when overlapping the fabric during tieing the fabric goes "face-to-face" causing it to hold to itself as when cutting out swimsuits the fabric is laid up, "face-to-face", to prevent slipping. When soiled, stained or otherwise spotted it can easily be washed with soap and water without shrinking or discoloring and then easily ironed thereby eliminating the need and expense of dry cleaning. It is an attractive tie having a bright yarn finish which gives it a luster generally brighter than silk. By selecting the "Lycra" content of the fabric the finish can be varied as desired from bright to dull. As can further be appreciated stretchable necktie 10 can be made in any configuration, width or length and also formed as a bow tie. A comfortable, washable and an attractive tie is thereby provided by this invention.

From the foregoing detailed description, it will evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A stretchable necktie comprising:

an elongated outer casing having a portion for encircling the human neck, a portion for forming a knot, and a portion for extending beyond the knot, wherein at least the portion for encircling the neck is formed of an unstretched stretchable nylon-spandex material.

2. The stretchable necktie of claim 1, wherein the portion for forming a knot is formed of an unstretched stretchable nylon-spandex material.

3. The stretchable necktie of claim 1, further comprising an elongated inner lining secured to said casing, said lining extending generally the length of said casing.

4. The stretchable necktie of claim 3, wherein said elongated inner lining is formed of an unstretched stretchable nylon-spandex material.

* * * * *